US005764147A

United States Patent [19]

Sasagawa et al.

[11] Patent Number: 5,764,147

[45] Date of Patent: Jun. 9, 1998

[54] ELECTRONIC ARTICLE SURVEILLANCE APPARATUS WITH AN ALARM

[75] Inventors: Shinichi Sasagawa; Seishi Namioka; Nobuyuki Ichimiya; Shin Kinouchi, all of Miyagi-ken, Japan

[73] Assignee: Alps Electric Co., Ltd., Tokyo, Japan

[21] Appl. No.: 624,040

[22] Filed: Mar. 27, 1996

[30] Foreign Application Priority Data

Apr. 7, 1995 [JP] Japan ..... 7-082776

[51] Int. Cl.[6] ..... G08B 13/14

[52] U.S. Cl. ..... 340/571; 340/572

[58] Field of Search ..... 340/571, 572, 340/693, 636

[56] References Cited

U.S. PATENT DOCUMENTS

| | | | |
|---|---|---|---|
| 4,151,520 | 4/1979 | Full | 340/528 |
| 4,573,042 | 2/1986 | Boyd et al. | 340/571 X |
| 4,686,513 | 8/1987 | Farrar et al. | 340/572 |
| 4,716,401 | 12/1987 | Wohlford et al. | 340/568 |
| 4,812,811 | 3/1989 | Asbrink et al. | 340/571 |
| 4,851,815 | 7/1989 | Enkelmann | 340/571 |
| 4,992,776 | 2/1991 | Crossfield | 340/572 X |
| 5,075,670 | 12/1991 | Bower et al. | 340/572 X |
| 5,239,284 | 8/1993 | Hara et al. | 340/571 X |
| 5,298,884 | 3/1994 | Gilmore et al. | 340/572 X |
| 5,367,289 | 11/1994 | Baro et al. | 340/572 X |
| 5,589,819 | 12/1996 | Takeda | 340/571 |

*Primary Examiner*—Thomas Mullen
*Attorney, Agent, or Firm*—Guy W. Shoup

[57] ABSTRACT

An electronic surveillance apparatus with an alarm, including a signal transmitter for producing a transmission signal, a tag for generating an alarm when the transmission signal from the signal transmitter is received while the tag is in a warning operation state, and a tag controller, which is selectively coupled to the tag, for controlling the warning operation state of the tag. The tag includes a signal receiving section, a warning generating section, a plurality of external connection terminals, a voltage dividing circuit which is connected to the plurality of external connection terminals, and a warning generation control section which is connected between the voltage dividing circuit and the warning generating section. The tag controller includes a plurality of external leadout terminals for connection to the external connection terminals, and a voltage generating section for selectively supplying at high voltage exceeding a power supply voltage of the tag to the plurality of external leadout terminals. The tag includes a power battery source for generating the power supply voltage which is connected to one of the external connection terminals, and the tag controller includes a battery level detection circuit which is connectable to the external leadout terminal through an external leadout terminal.

4 Claims, 3 Drawing Sheets

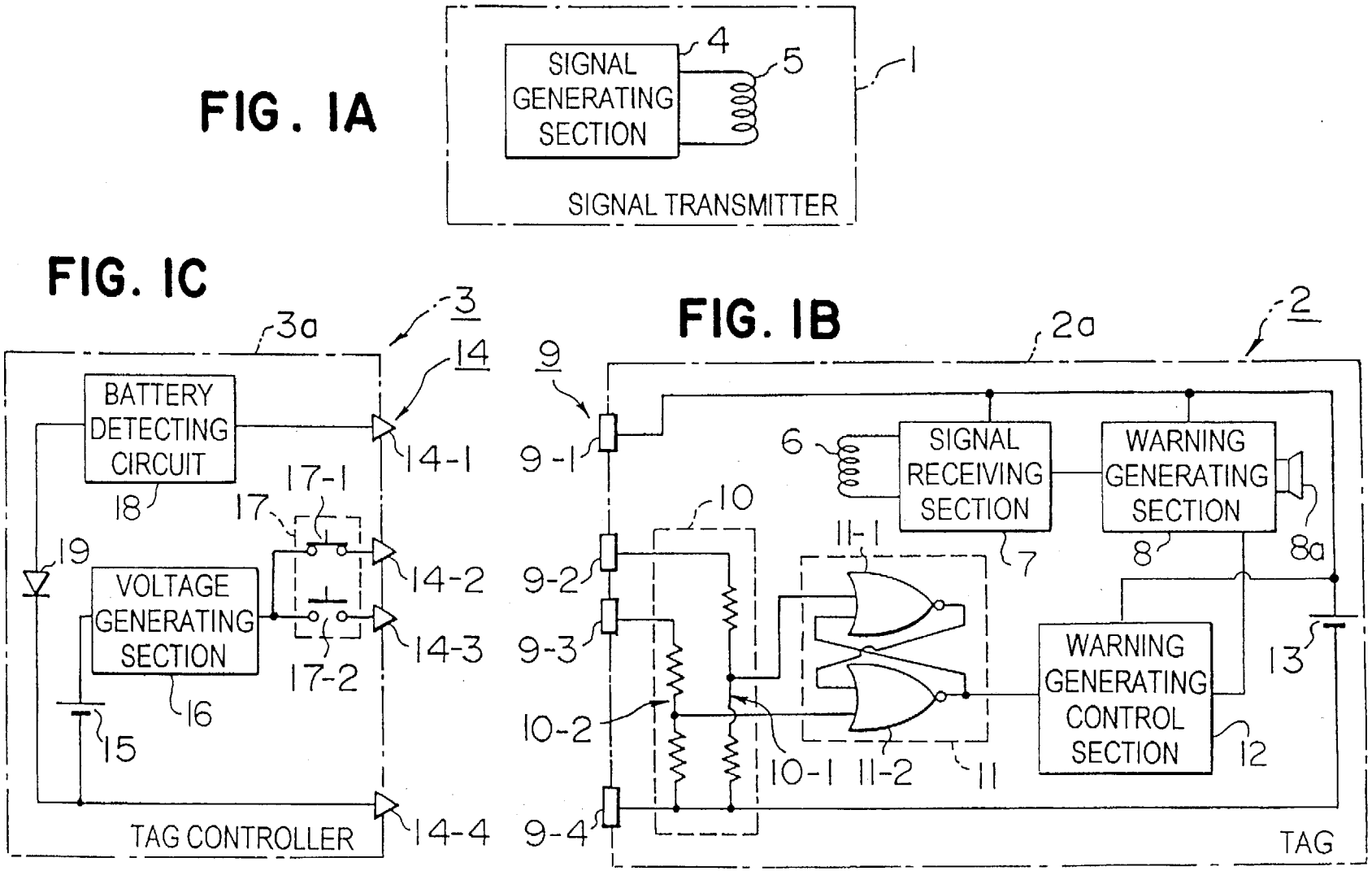
FIG. IA
FIG. IB
FIG. IC

ELECTRONIC ARTICLE SURVEILLANCE APPARATUS WITH AN ALARM

BACKGROUND OF THE INVENTION

1. Field of the Invention

The present invention relates to an electronic article surveillance apparatus (hereinafter referred to as an E.A.S. apparatus) with an alarm. More particularly, the present invention relates to an E.A.S. apparatus with an alarm comprising a tag controller which is selectively connected to tags, which tag controller controls the warning generation operating state of the tag and which tag controller detects the level of the battery power of the tag as well as controls the warning generation operating state.

2. Description of the Related Art

Hitherto, an E.A.S. apparatus with an alarm has already been known in which a signal transmitter for radiating signal waves is disposed in only a surveillance control area which is monitored by the E.A.S. apparatus, wherein tags are respectively attached to merchandise articles or the like displayed within a surveillance control area where the radiated signal waves from the signal transmitter cannot reach, and when one or more of the tags are moved to a range where the radiated signal waves from the signal transmitter can reach, for example, the doorway of a shop, together with the merchandise article or the like, the tag receives the radiated signal waves, causing a warning to be generated without stopping the warning generation function, thus informing the salesclerk or other member of the fact that the merchandise article or the like is being taken out illegally.

These tags are such that when a warning is issued once, the generation of the warning cannot be stopped unless a specific operation is performed. Normally, as shown in FIG. 3, a tag control bar 53 which is prepared separately is inserted into a hole **51*h* provided in a housing 51*a* of a tag 51, and a warning generation stop switch 52 within the tag 51 is operated by the tip of the tag control bar 53** in order to stop the generation of the warning.

In the above-described known E.A.S. apparatus, a warning generated from the tag 51 is stopped by the tag control bar 53. If a malicious person comes to know that the warning generation stop switch 52 is present in the inner portion of the hole **51*h* of the housing 51*a* of the tag 51 and inserts a bar-shaped member, such as a ubiquitous needle, into the hole 51*h* of the housing 51*a* in place of the tag control bar 53 and operates the warning generation stop switch 52 by the tip of the bar-shaped member, the generation of a warning from the tag 51 can be prevented. Further, even if the tag 51 which is made to stop generating a warning reaches the range in which the radiated signal waves from the signal transmitter reach, for example, the doorway of a shop, together with the merchandise article or the like, and receives the radiated signal waves, a warning will not be issued from the tag 51**.

As described above, the known E.A.S apparatus described above has a problem in that the warning generation function of the tag 51 can be relatively easily prevented, and thus the E.A.S. apparatus does not always have a high level of reliability.

In the above-described known E.A.S. apparatus, since the respective tags 51 are activated by the respective built-in battery powers, the built-in battery power must be replaced when the tag 51 is used for a fixed period of time.

However, since the above-described known E.A.S. apparatus with an alarm is not provided with a function for detecting the level of the power battery of the tag 51, there is a case in which it is not observed that the effective use period of the power battery has elapsed and its output is greatly reduced, and the tag 51 with the power battery contained therein continues to be used. In another example, there is a tag 51 in which even though there is a sufficient effective use period remaining, the power battery is replaced. In the merchandise article or the like to which the tag 51 having a built-in power battery whose use effective period has elapsed is attached, even if the merchandise article or the like is carried out of the shop, the tag 51 will not function effectively.

As described above, the known E.A.S. apparatus described above has a problem in that since the replacement time of the respective power batteries cannot be detected, the tag 51 might not perform the warning generation function, or a power battery which is still usable might be discarded.

SUMMARY OF THE INVENTION

The present invention solves the above-described problems. It is an object of the present invention to provide a E.A.S. apparatus with an alarm having high reliability and high security, such that the warning generation operation of a tag cannot be controlled by a malicious person by an easy operation or a simple device.

It is another object of the present invention to provide an E.A.S. apparatus with an alarm which is capable of easily detecting the level of the power in the battery contained in a tag.

To achieve the above-described object, the present invention provides first means comprising: a signal transmitter for producing a transmission signal; a tag for generating a warning when the transmission signal from the signal transmitter is received in a state in which the warning operation is not stopped; and a tag controllers which is selectively coupled to the tag, for controlling the warning generation operation of the tag, wherein the tag includes: a signal receiving section, a warning generating section, a plurality of external connection terminals, a voltage dividing circuit which is connected to the plurality of external connection terminals, and a warning generation control section which is connected between the voltage dividing circuit and the warning generating section, and wherein the tag controller includes: a plurality of external readout terminals which are capable of being connected to the plurality of external connection terminals, and a voltage generating section for selectively supplying a high voltage exceeding the power voltage of the tag to the plurality of external leadout terminals.

To achieve the above and the other object, the present invention provides second means comprising: a signal transmitter for producing a transmission signal; a tag for generating a warning when the transmission signal from the signal transmitter is received in a state in which the warning operation is not stopped; and a tag controller, which is selectively coupled to the tag, for controlling the warning generation operation of the tag, wherein the tag includes: a signal receiving section, a warning generating section, a plurality of external connection terminals, one external connection terminal for detecting a voltage, a voltage dividing circuit which is connected to the plurality of external connection terminals, a battery power which is connected to the external connection terminal for detecting a voltage, and a warning generation control section which is connected between the voltage dividing circuit and the warning generating section, and wherein the tag controller includes: a plurality of external leadout terminals which are capable of being connected to the plurality of external connection terminals, one external leadout terminal which is capable of being connected to the external connection terminal for detecting a voltage, a voltage generating section for selectively supplying a high voltage exceeding the battery voltage to the plurality of external leadout terminals, and a battery level detection circuit which is connected to the one external leadout terminal.

According to the first means, in a case in which when the warning generation section of the tag operates and the warning is being generated from the tag, it is desired to stop the warning, or in a case in which when the warning generation section of the tag is not operated and no warning is being issued from the tag, an attempt is made to bring about a state in which a warning can be generated from the tag, a tag controller is used. The tag controller has a plurality of external leadout terminals connected to a plurality of external connection terminals of the tag, and thus a connection with the tag is made. When the tag controller is connected to the tag, a high voltage (a voltage substantially higher than the power battery voltage of the tag, e.g., approximately 40 V) obtained in the voltage generation section of the tag controller is supplied to the tag through the plurality of external leadout terminals and the plurality of external connection terminals. On the tag side, the operation of the warning generation section is controlled by supplying the high voltage, causing the warning generation operation of the tag to stop or start.

As described above, according to the first means, the control of the stopping or starting of the warning generation operation of the tag is effected only when a high voltage is selectively supplied from the tag controller to the tag. Therefore, the control of the warning generation operation of the tag cannot be effected by an easy operation or a simple device, and therefore an E.A.S apparatus with an alarm having higher reliability and higher security, by an amount corresponding to the above-mentioned difficulty, can be obtained.

According to the second means, in addition to the above-stated case in which the warning generation section of a tag operates, and the warning is desired to be stopped when a warning is being issued from the tag, or a case in which when the warning generation section of the tag is not operated and no warning is being issued from the tag, an attempt is made to place the tag in a state in which a warning can be generated from the tag, even in a case in which when the warning generation section of the tag operates and the warning is being generated from the tag, it is desired to stop the warning, or in a case in which when the warning generation section of the tag is not operated and no warning is being issued from the tag, a high voltage obtained in the voltage generation section of the tag controller is supplied to the tag through the plurality of external leadout terminals and the plurality of external connection terminals. On the tag side, in addition to the above-stated case in which the operation of the warning generation section is controlled by supplying the high voltage, causing the warning generation operation of the tag to stop or start, the voltage of the power battery of the tag is supplied to the tag controller through one external connection terminal and one external leadout terminal, and the tag controller supplies the voltage to the battery level detecting circuit in order to measure the level of the voltage of the power battery.

As described above, according to the second means, in addition to the effect expected by the above-described first means, it becomes possible to detect the voltage of the power battery of the tag, and the situation can be prevented in which a warning cannot be generated from the tag because a power battery whose use effective period has elapsed greatly is still being used, or a power battery in which there is a sufficient effective use period left is replaced, and the resources are thus wasted.

The above and further objects, aspects and novel features of the invention will become more apparent from the following detailed description when read in connection with the accompanying drawings

BRIEF DESCRIPTION OF THE DRAWINGS

FIGS. 1A, 1B, and 1C are block diagrams illustrating the essential portion of an embodiment of an E.A.S. apparatus with an alarm according to the present invention;

DESCRIPTION OF THE PREFERRED EMBODIMENT

A preferred embodiment of the present invention will be described below with reference to the accompanying drawings.

Figure 2A:
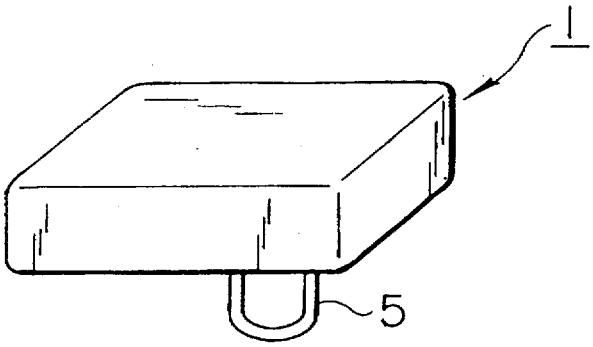
FIGS. 2A, 2B, and 2C are perspective views illustrating the exterior of the E.A.S apparatus with an alarm shown in FIGS. 1A, 1B, and 1C.
Figure 2B:
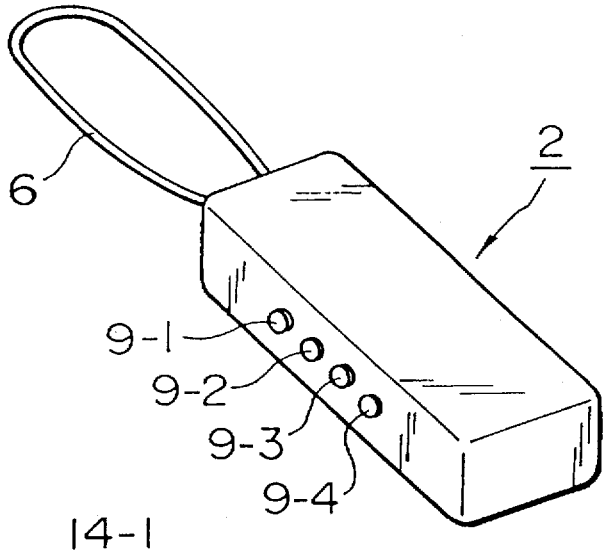
Figure 2C:
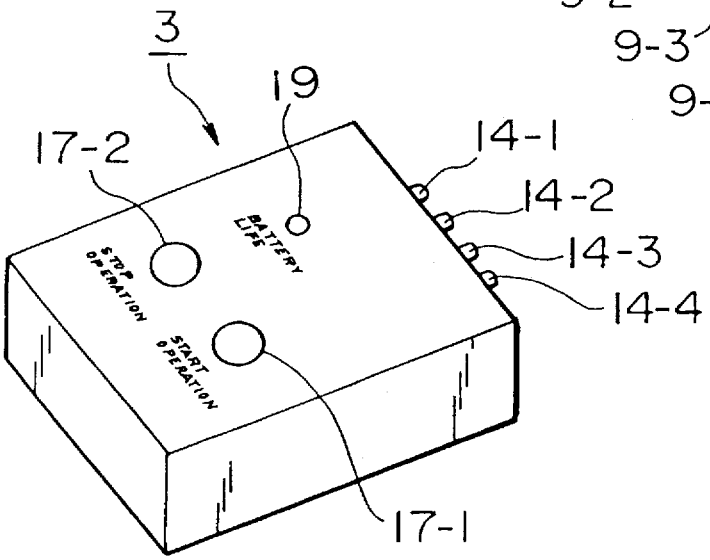
Figure 3:
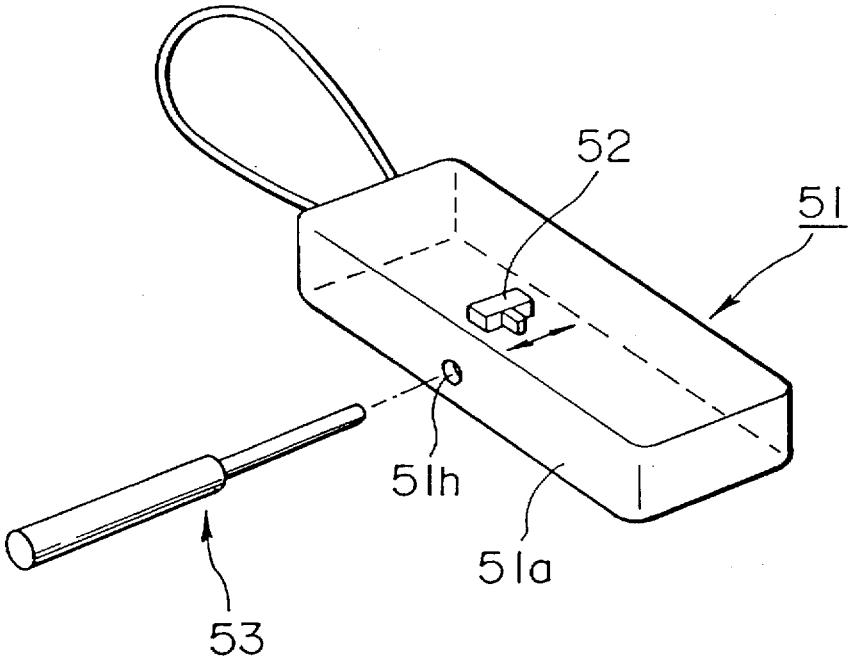
FIG. 3 (PRIOR ART)
FIG. 3 is a schematic illustration of the constructions of a known tag, and a tag control bar for stopping the generation of a warning.

FIGS. 1A, 1B, and 1C are block diagrams illustrating the essential portion of an embodiment of an E.A.S. apparatus with an alarm according to the present invention. FIGS. 2A, 2B, and 2C are perspective views illustrating the exterior of the E.A.S. apparatus with an alarm shown in FIGS. 1A, 1B, and 1C. FIGS. 1A and 2A illustrate a signal transmitter, FIGS. 1 and 2B illustrate a tag, and FIGS. 1C and 2C illustrate a tag controller.

As shown in FIGS. 1A to 1C, and FIGS. 2A to 2C, the E.A.S. apparatus with an alarm of this embodiment comprises a signal transmitter 1, a tag 2, and a tag controller 3. The signal transmitter 1 comprises a signal generating section 4 for generating a modulated signal obtained by modulating a carrier signal in accordance with a modulation signal, and a transmission antenna 5 for radiating this modulated signal to the space as waves. The tag 2 comprises a reception antenna 6 for sensing the modulated signals from the signal transmitter 1, a signal receiving section 7 for amplifying and demodulating the modulated signals sensed by the reception antenna 6 and for producing a modulation signal, a warning generation section 8 for activating an alarm **8*a* by supplying the modulation signal in order to generate a warning, a connection portion 9 formed of first to fourth external connection terminals 9-1 -to 9-4 provided in a housing 2*a*, a voltage dividing circuit 10 comprising two series-connected resistors 10-1 and 10-2 for selectively producing two voltage-divided outputs, a switch circuit (flip-flop circuit) 11 comprising two cross-connected NOR gates 11-1 and 11-2 for generating a voltage of a different polarity according to the two voltage-divided outputs, a warning generation control section 12 for supplying a first or second control signal to the warning generation section 8 according to the polarity of the output voltage of the switch circuit 11, and a built-in power battery 13. The tag controller 3 comprises a connection portion 14 formed of first to fourth external leadout terminals 14-1 to 14-4 provided in a housing 3*a*, a power battery 15, a voltage generation section 16 for raising the voltage of the power battery 15 and generating a voltage substantially higher than the power battery 13 of the tag 2, e.g., approximately 40 V, a change switch 17 comprising two switches 17-1 and 17-2 which are alternately turned on/off, a battery level detecting circuit 18 for detecting the voltage of the power battery 13 of the tag 2, and a light emitting diode (display element) 19 for indicating the lighting state according to the detected result of the battery level detecting circuit 18. In this case, the first to fourth external connection terminals 9-1 to 9-4 provided in a housing 2***a* of the tag 2, and the first to fourth external leadout terminals 14-1 to 14-4 provided in the housing 3*a* of the tag controller 3 completely correspond to each other in the arrangement position and the dimensions It is possible to fit the first to fourth external readout terminals 14-1 to 14-4 to the first to fourth external connection terminals 9-1 to 9-4, respectively When the fitting of them is done, the tag 2 is coupled to the tag controller 3.

In the signal transmitter 1, the transmission antenna 5 is connected to the output side of the signal generating section 4. In the tag 2, the reception antenna 6 is connected to the input side of the signal receiving section 7, and the input of the warning generation section 8 is connected to the output of the signal receiving section 7. The warning generation section 8 has the built-in alarm 8*a*, and the output of the warning generation control section 12 is connected to the warning generation section 8. The power battery 13 is connected between the first external connection terminal 9-1 and the fourth external connection terminal 9-4, one of the series-connected resistor 10-1 is connected between the second external connection terminal 9-2 and the fourth external connection, terminal 9-4, and the other series-connected resistor 10-2 is connected between the third external connection terminal 9 and the fourth external connection terminal 9-4. The output end of one of the series-connected resistors 10-1 is connected to one of the inputs of the NOR gates, 11-1, and the output end of the other series-connected resistor 10-2 is connected to one of the inputs of the NOR gates, 11-2, the output of one of the NOR gates 11-1 is connected to the other input of the other NOR gate 11-2, and the output of the other NOR gate 11-2 is connected to the other input of the NOR gate, 11-1, and to the input of the warning generation control section 12.

In the tag controller 3, the input of the battery level detecting circuit 18 is connected to the first external leadout terminal 14-1, and the light emitting diode 19 is connected between the output of the battery level detecting circuit 18 and the fourth external leadout terminal 14-4. One end of one of the switches 17-1 is connected to the second external leadout terminal 14-2, and the output of the voltage generation section 16 is connected to the other end of one of the switches 17-1. One end of the other switch 17-2 is connected to the third external leadout terminal 14-3, and the output of the voltage generation section 16 is connected to the other end of the other switch 17-2 The power battery 15 is connected between the input of the voltage generation section 16 and the fourth external leadout terminal 14-4.

The E.A.S. apparatus with an alarm having the above-described construction of this embodiment operates as described below.

First, if it is assumed that a predetermined place of a surveillance control area is, for example, the merchandise article display area of the shop, the signal transmitter 1 is disposed near the doorway of the shop so that the modulated signal waves to be transmitted are radiated in a concentrated area adjacent the doorway. In parallel with this, the respective tags 2 are attached to the merchandise article or the like to be monitored, it is confirmed that the tag 2 does not sense the modulated signal waves from the signal transmitter 1, and the surveillance operation is initiated.

In this state, when the merchandise article or the like to which the tag 2 is attached remains at the position where it should be inside the shop, or when the merchandise article or the like is moved from the position where it should be by the shopper and the moved range thereof is inside the shop excluding the proximity of the doorway, the tag 2 which is attached to the merchandise article or the like does not enter the service area of the modulated signal waves to be transmitted from the signal transmitter 1, and the waves are not received by the signal receiving section 7 in the tag 2. Therefore, in the tag 2, a modulation signal is not produced from the signal receiving section 7, and no warning is generated from the warning generation section 80.

On the other hand, when the shopper attempts to move the merchandise article or the like to which the tag 2 is attached and reaches the proximity of the doorway of the shop, the tag 2 enters the service area of the modulated signal waves which are transmitted from the signal transmitter 1, the waves are detected by the reception antenna 6 of the tag 2, and the waves are received by the signal receiving section 7. Therefore, in this tag 2, the modulation signal is produced from the signal receiving section 7, the warning generation section 8 is caused to be operable by the modulation signal and a warning is issued from the alarm 8*a*. If, as described above, the tag 2 which is attached to the merchandise article or the like and whose warning generation has not been stopped passes the doorway of the shop together with the shopper, the tag 2 senses the modulated signal waves transmitted from the signal transmitter 1 and automatically generates a warning. Thus, it is possible for the salesclerk or other member to know that the merchandise article or the like is being taken out illegally.

The tag 2, when a warning is generated once, does not stop the warning even if the supply of the modulated signal waves transmitted from the signal transmitter 1 is stopped, and continues to sound the warning until the built-in power battery 13 is completely consumed. Therefore, when a warning is generated from the tag 2, it is necessary to forcedly stop the generation of the warning at a certain point in time.

In this embodiment, the tag controller 3 is used to stop the generation of the warning of the tag 2. The tag controller 3 is placed beside the tag 2 which is generating a warning, and the first to fourth external connection terminals 9-1 to 9-4 on the tag 2 side are fitted into the first to fourth external leadout terminals 14-1 to 14-4 on the tag controller 3 side, respectively, and thus the tag 2 is coupled to the tag controller 3. At this time, in the tag controller 3, the switch 17-2 on the operation stop side from among the two switches 17-1 and 17-2 exposed from the housing 3*a* is operated to turn off the switch 17-1 and to turn on the switch 17-2. When the tag controller 3 is coupled to the tag 2, the high voltage of the voltage generation section 16, i.e., a high voltage substantially higher than the voltage of the power battery 13 of the tag 2, e.g., 40 V, is supplied to the third external leadout terminals 14-3 through the switch 17-2 which is turned on, and supplied to the third external connection terminal 9-3 to which the third external leadout terminals 14-3 is connected. Then, the high voltage generated in the third external connection terminal 9-3 is divided by one of the series-connected resistors 10-1 of the voltage dividing circuit 10, and supplied as a voltage which is substantially the same as the voltage of the power battery 13 to the other NOR gate 11-2 of the switch circuit 11, causing the output of the other NOR gate 11-2 to decrease to the low level (ground voltage). Then, when this ground voltage is supplied to the warning generation control section 12, the warning generation control section 12 generates a first control signal. The warning generation section 8 to which this first control signal has been supplied is changed from an operable state to a non-operable state, thereby stopping the generation of the warning from the alarm 8*a*. When, as described above, the tag controller 3 is coupled to the tag 2 which is not generating a warning, after passing through the same operation as the above-described operation, no warning is generated from the tag 2 even if the tag 2 receives the modulated signal waves from the signal transmitter 1.

In this embodiment, on the other hand, the tag controller 3 is used also to generate a warning from the tag 2. The tag controller 3 is placed beside the tag 2 which is generating a warning, and the first to fourth external connection terminals 9-1 to 9-4 on the tag 2 side are fitted into the first to fourth external leadout terminals 14-1 to 14-4 on the tag controller 3 side, respectively, and thus the tag 2 is coupled to the tag controller 3. At this time, the switch 17-1 on the operation start side from among the two switches 17-1 and 17-2 exposed from the housing 3*a* of the tag controller 3 is operated to turn on the switch 17-1 and turn off the switch 17-2. When the tag controller 3 is coupled to the tag 2, the high voltage of the voltage generation section 16 is supplied to the second external leadout terminal 14-2 through the switch 17-1 which is turned on, and supplied to the second external connection terminal 9-2 to which the second external readout terminal 14-2 is connected. Then, the high voltage developed in the second external connection terminal 9-2 is divided to a voltage which is substantially equal to the voltage of the power battery 13 by one of the series-connected resistors 10-1 of the voltage dividing circuit 10, after which the voltage is supplied to one of the NOR gates 11-1 of the switch circuit 11, and the output of the NOR gates 11-1 is lowered to the lower level (ground voltage), and the output of the other NOR gate 11-2 is raised to a high level (the voltage of the power battery 13, i.e., the power-supply voltage). Then, when the power-supply voltage obtained in the output of the other NOR gate 11-2 is supplied to the warning generation control section 12, the warning generation control section 12 generates a second control signal, the warning generation section 8 to which this second control signal has been supplied is changed from the non-operable state to the operable state, causing the alarm 8*a* to generate a warning.

In this case, even if a third party who comes to know that it is possible to stop the generation of the warning of the tag 2 if a DC voltage is supplied to the third external connection terminal 9-3 of the tag 2 supplies a DC voltage to the third external connection terminal 9-3 of the tag 2 from a commercially available battery in order to stop the generation of the warning from the tag 2, the output voltage of the commercially available battery is a low voltage of approximately 3 to 9 V at most. When the low voltage is divided by the other series-connected resistor 10-2, the output voltage becomes a considerably low voltage of approximately 3 V or less. Since this considerably low voltage is below the threshold voltage or less of the switch circuit 11, even if the voltage is supplied to the other series-connected resistor 10-2, the output of the other series-connected resistor 10-2 cannot be turned to a low level (ground voltage), and therefore the warning generation control section 12 does not supply the first control voltage to the warning generation section 8. Therefore, it is not possible to stop the warning generated from the tag 2.

As described above, according to this embodiment, the tag controller 3 is coupled to the tag 2, and only when a voltage substantially higher than the voltage of the power battery 13 of the tag 2, e.g., 40 V, is supplied from the tag controller 3 to the tag 2, the warning generation operation of the tag 2 is stopped or started, Therefore, the control of the warning generation operation of the tag 2 cannot be effected by an easy operation or a simple device, and therefore an E.A.S. apparatus with an alarm having higher reliability and higher security, by an amount corresponding to the above-mentioned difficulty, can be obtained.

As the E.A.S apparatus with an alarm of this embodiment having the above-described construction is capable of detecting the level of the power battery 13 of the tag 2, a description will be given below of the operation of detecting the level of the power battery 13 of the tag 2.

The tag controller 3 is placed beside the tag 2 whose level of the power battery 13 is desired to be detected, and the first to fourth external leadout terminals 14-1 to 14-4 on the tag controller 3 side are fitted into the first to fourth external connection terminals 9-1 to 9-4 on the tag 2 side, respectively, and thus the tag 2 is coupled to the tag controller 3. When the tag controller 3 is coupled to the tag 2, the voltage of the power battery 13 is supplied to the first external connection terminal 9-1 and supplied also to the first external leadout terminal 14-1 to which the first external connection terminal 9-1 is connected. Then, the voltage of the power battery 13 obtained in the first external leadout terminal 14-1 is supplied to the battery level detecting circuit 18. At this time, when the supplied voltage of the power battery 13 is higher than the preset allowable power battery voltage, the battery level detecting circuit 18 does not send out a drive current to the light emitting diode 19, and thus the light emitting diode 19 is not turned on. When the supplied voltage of the power battery 13 is equal to or lower than the preset allowable power battery voltage, the battery level detecting circuit 18 sends out a drive current to the light emitting diode 19, and thus the light emitting diode 19 is turned on.

The level of the power battery 13 of the tag 2 may be detected at the same time as when the warning generation operation of the tag 2 is stopped or started, or only the level of the power battery 13 of the tag 2 may be detected after the high voltage to be generated from the tag controller 3 is stopped by some means and then the tag controller 3 is coupled to the tag 2 to be detected.

According to this embodiment, as has already been described, in addition to the effect obtained during the control of the stopping or starting of the warning generation operation of the tag 2, it becomes possible to detect the level of the voltage of the power battery 13 of the tag 2, and the situation can be prevented in which a warning cannot be generated from the tag because a power battery 13 whose effective use period has elapsed greatly is still being used, or a power battery in which there is a sufficient effective use period left is replaced, and the resources are thus wasted.

The above-described embodiment describes an example in which a circuit portion for controlling (stopping or starting) the warning generation operation of the tag 2 and a circuit portion for detecting the level of the power battery 13 of the tag 2 are incorporated in both the tag 2 and the tag controller 3. In accordance with a first aspect of the present invention, a member in which only the circuit portion for controlling (stopping or starting) the warning generation operation of the tag 2 is incorporated in both the tag 2 and the tag controller 3 may be used. At this time, naturally, only the warning generation operation of the tag 2 can be controlled.

The above-described embodiment describes an example in which the high voltage generated in the voltage generation section 16 is approximately 40 V, the high voltage used in the present invention is not limited to 40 V. However, of course, a voltage other than that voltage may be used if it is clear that the voltage is higher -than that of the power battery 13.

The above-described embodiment uses a switch circuit 11 in which two NOR gates 11-1 and. 11-2 are cross-connected as a switch circuit, i.e., a flip-flop circuit. The switch circuit 11 used in the present invention is not limited to a circuit of such a construction. However, of course, a switch circuit 11 of another construction employing another logic circuit device may be used.

As described above, according to the first aspect of the present invention, only when the tag controller 3 is coupled to the tag 2, and a high voltage is selectively supplied from the tag controller 3 to the tag 2, the warning generation operation of the tag 2 is stopped or started. Therefore, there is the advantage that the stopping and starting of the warning generation operation of the tag cannot be performed by an easy operation or a simple device, and therefore an E.A.S. apparatus with an alarm having higher reliability and higher security, by an amount corresponding to the above-mentioned difficulty, can be obtained.

According to a second aspect of the present invention, in addition to the effect expected by the first aspect of the invention it becomes possible to detect the voltage state of the power battery 13 of the tag 2 by the tag controller 3 which is connected to the tag 2. Thus, there is the advantage that the situation can be prevented in which a warning cannot be generated from the tag 2 because a power battery 13 whose use effective period has elapsed greatly is still being used, or a power battery 13 in which there is a sufficient effective use period left is replaced, and the resources are thus wasted.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An electronic surveillance apparatus with an alarm, comprising:

a signal transmitter for producing a transmission signal;

a tag for generating a warning when said transmission signal from said signal transmitter is received while the tag is in a warning operation state; and a tag controller, which is selectively coupled to said tag, for controlling the warning operation state of said tag, wherein said tag includes: a signal receiving section, a warning generating section, a plurality of external connection terminals, a voltage dividing circuit which is connected to said plurality of external connection terminals, and a warning generation control section which is connected between said voltage dividing circuit and said warning generating section, and wherein said tag controller includes: a plurality of external leadout terminals which are capable of being connected to said plurality of external connection terminals, and a voltage generating section for selectively supplying a high voltage exceeding a power supply voltage of said tag to said plurality of external leadout terminals.

2. An electronic article surveillance apparatus with an alarm according to claim 1, wherein in said tag, a switch circuit which is controlled on the basis of an output of said voltage dividing circuit is connected between said voltage dividing circuit and said warning generation control section.

3. An electronic surveillance apparatus with an alarm, comprising:

a signal transmitter for producing a transmission signal;

a tag for generating a warning when said transmission signal from said signal transmitter is received while the tag is in a warning operation state; and a tag controller, which is selectively coupled to said tag, for controlling the warning operation state of said tag, wherein said tag includes: a signal receiving section, a warning generating section, a plurality of external connection terminals, one external connection terminal for detecting a voltage, a voltage dividing circuit which is connected to said plurality of external connection terminals, a power battery source which is connected to said one external connection terminal, and a warning generation control section which is connected between said voltage dividing circuit and said warning generating section, and wherein said tag controller includes: a plurality of external leadout terminals which are capable of being connected to said plurality of external connection terminals, one external leadout terminal which is capable of being connected to said one external connection terminal, a voltage generating section for selectively supplying a high voltage exceeding a power supply voltage generated by the power battery source to said plurality of external leadout terminals, and a battery level detection circuit which is connected to said one external leadout terminal.

4. An electronic article surveillance apparatus with an alarm according to claim 3, wherein said battery level detection circuit of said tag controller is connected in series with a display element.

* * * * *